US006915579B2

(12) United States Patent
Cofer

(10) Patent No.: US 6,915,579 B2
(45) Date of Patent: Jul. 12, 2005

(54) PUNCH ASSEMBLY AND METHODS OF USING SAME

(76) Inventor: Archie Cofer, P.O. Box 685, Nicoma Park, OK (US) 73066

( * ) Notice: Subject to any disclaimer, the term of this patent is extended or adjusted under 35 U.S.C. 154(b) by 0 days.

(21) Appl. No.: 10/656,455

(22) Filed: Sep. 4, 2003

(65) Prior Publication Data

US 2004/0123713 A1 Jul. 1, 2004

Related U.S. Application Data

(60) Provisional application No. 60/407,876, filed on Sep. 4, 2002.

(51) Int. Cl.[7] ..... B26F 1/32
(52) U.S. Cl. ..... 30/368; 30/233
(58) Field of Search ..... 30/368, 358, 178, 30/233, 229, 293; 83/560

(56) References Cited

U.S. PATENT DOCUMENTS

| | | | | |
|---|---|---|---|---|
| 503,109 A | | 8/1893 | Davis et al. | |
| 600,587 A | | 3/1898 | Low | |
| 1,376,492 A | | 5/1921 | Whitney | |
| 1,750,929 A | | 3/1930 | Griswold | |
| 2,364,011 A | * | 11/1944 | Wales | 83/140 |
| 2,980,997 A | | 4/1961 | Hendricks | |
| 4,033,037 A | | 7/1977 | Cooley | |
| 4,488,358 A | | 12/1984 | Leggett, Jr. | |
| 5,560,110 A | * | 10/1996 | Haines | 30/363 |
| 6,367,362 B1 | | 4/2002 | Brazell et al. | |

* cited by examiner

*Primary Examiner*—Douglas D Watts
(74) *Attorney, Agent, or Firm*—Dunlap, Codding and Rogers P.C.

(57) ABSTRACT

The present invention relates, in general, to a punch assembly and methods of using same and, more particularly, to a punch assembly that is capable of accurately and repeatedly measuring an intersecting point at which a hold or indentation can be put in a sheet of material such as, but not by way of limitation, a sheet of metal.

2 Claims, 5 Drawing Sheets

PUNCH ASSEMBLY AND METHODS OF USING SAME

CROSS-REFERENCE TO RELATED APPLICATIONS

This application relates to U.S. Provisional patent application, U.S. Ser. No. 60/407,876, filed Sep. 4, 2002, entitled PUNCH ASSEMBLY AND METHODS OF USING SAME.

BACKGROUND OF THE INVENTION

FIELD OF THE INVENTION

The present invention relates, in general, to a punch assembly and methods of using same and, more particularly, to a punch assembly that is capable of accurately and repeatedly measuring an intersecting point at which a hold or indentation can be put in a sheet of material such as, but not by way of limitation, a sheet of metal.

DETAILED DESCRIPTION OF THE INVENTION

Figure 1:
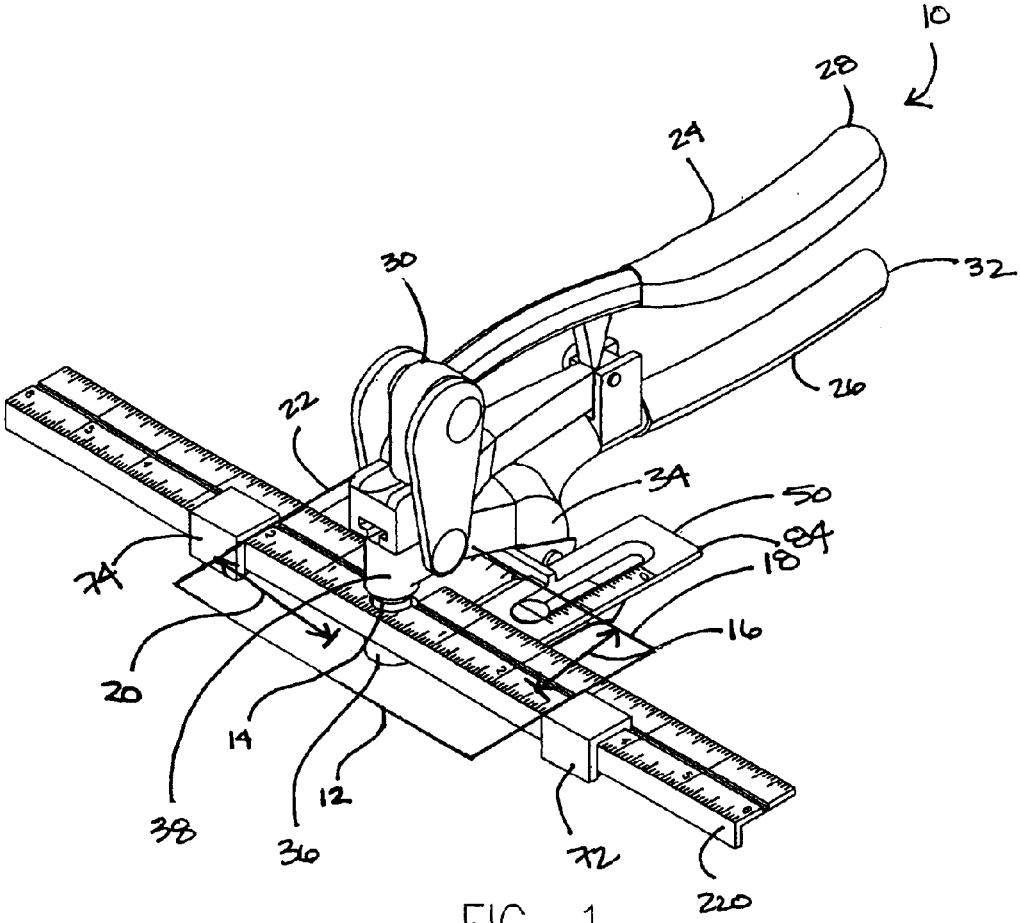
FIG. 1 is a top perspective view of a punch assembly constructed in accordance with the present invention.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for purpose of description and should not be regarded as limiting.

Referring now to FIG. 1 shown therein is a punch assembly 10, constructed in accordance with the present invention and a sheet of material 12 properly positioned in the punch assembly 10 for punching. The punch assembly 10 is for punching a hole through or making an indentation in the sheet of material 12 at an intersection 14 of a first distance 16 as measured from a first side 18 of the piece of material 12 and a second distance 20 as measured from a second side 22 of the piece of material 12.

The punch assembly 10 has a first handle 24 and a second handle 26. The first handle 24 has a proximal end 28 and a distal end 30. The second handle 26 has a proximal end 32 and a distal end 34. The distal end 34 of the second handle 26 has a receiver assembly 36 having a center 37. The distal end 30 of the first handle 24 is in contact with a blade assembly 38. The first handle 24 and the second handle 26 are pivotally connected such that the blade assembly 38 moves toward the receiver assembly 36 and into the receiver assembly 36 as the proximal end 28 of the first handle 24 is pivoted toward the proximal end 32 of the second handle 26. Likewise, the blade assembly 38 moves out of the receiver assembly 36 and away from the receiver assembly 36 as the proximal end 32 of the second handle 26 is pivoted away from the proximal end 28 of the first handle 24. One of ordinary skill in the art would, given the present specification and drawings, understand that the punch assembly 10 is not limited to the first handle 24 and the second handle 26 embodiment shown in FIG. 1. Rather, the punch assembly 10 may include any mechanism or biasing means (such as the first handle 24 and the second handle 26) so long as the blade assembly 38 is capable of being merely punched through and/or into the sheet of material 12 and thereafter into or in contact with the receiver assembly 36.

Figure 2:
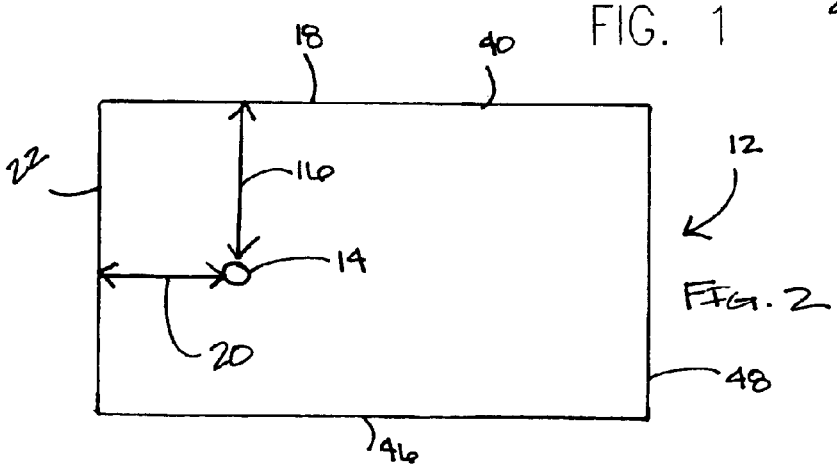
FIG. 2 is a top plan view of a piece of material for use with the punch assembly of FIG. 1.

Referring now to FIG. 2, shown in more detail is the sheet of material 12 suitable for punching a hole in or making an indentation in with the punch assembly 10. For example, but not by way of limitation, the sheet of material 12 may be a sheet of steel, iron, wood, laminate and may be, in an alternate embodiment, a three-dimensional object such as a tube, j-channel, etc. The sheet of material 12 is substantially planar in configuration in the embodiment shown in FIG. 2. The sheet of material 12 has an outer periphery 40. The outer periphery 40 of the sheet of material 12 is typically rectangular or square in configuration such that the outer periphery 40 (in addition to the first side 18, and the second side 22) further includes a third side 46 opposite the first side 18 and a fourth side 48 opposite the second side 22. Although the sheet of material 12 is shown and described as a sheet of material, those skilled in the art will readily recognize and understand that the punch assembly 10 can be utilized for punching holes or making indentations in other configurations of material (i.e. three-dimensional objects) such as a sheet of metal that is formed into the configuration of a U channel.

Figure 3:
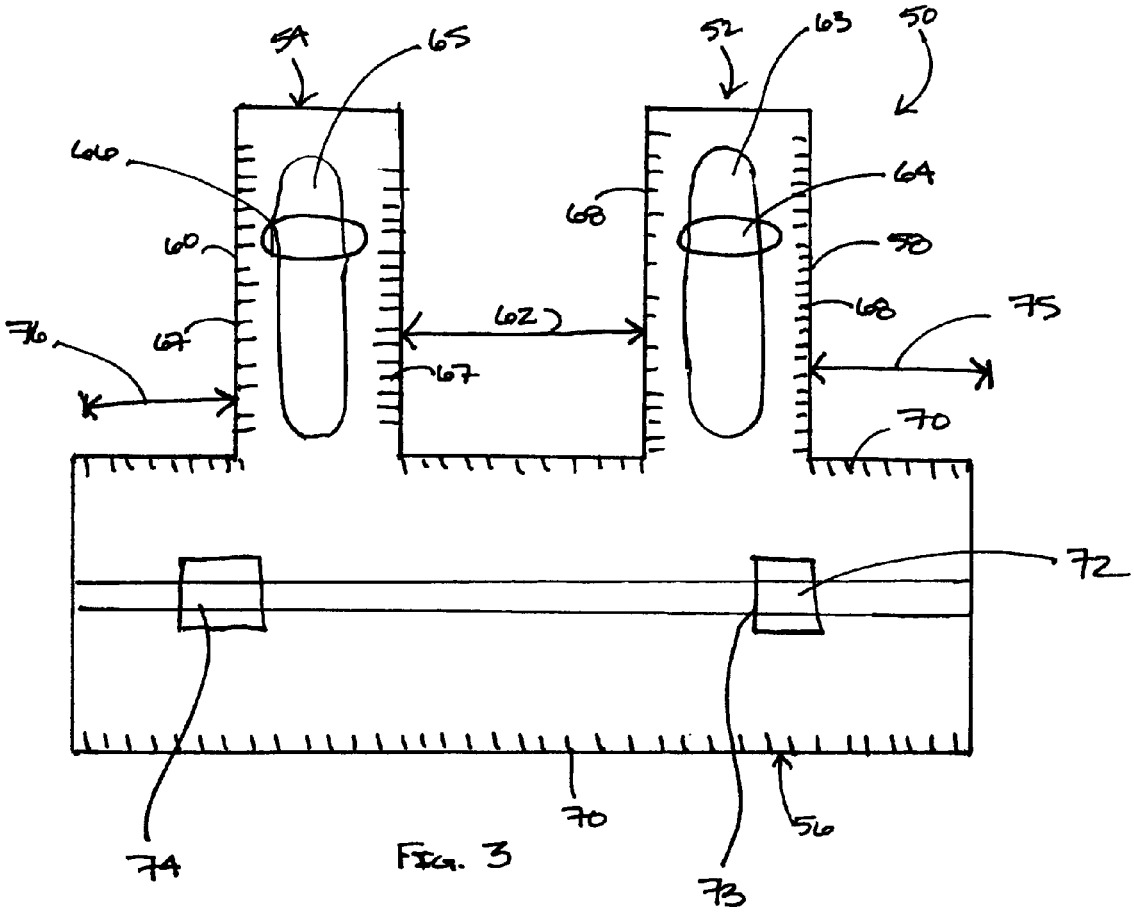
FIG. 3 is a top plan view of a measuring member of the punch assembly of FIG. 1.

Referring now to FIG. 3, the punch assembly 10 further includes a measuring member 50 capable of measuring and laying out the first distance 16, the second distance 20, and a third distance 21. The measuring member 50, in one embodiment, is substantially planar and has a modified U shaped configuration although other shapes may be utilized as will be apparent to one of ordinary skill in the art. The measuring member 50 is slidably attached to and extends from the distal end 34 of the second handle 26 of the punch assembly 10. The measuring member 50 has a first appendage 52, a second appendage 54 and a third appendage 56. The first appendage 52 has an outer periphery 58 that may, in one embodiment shown in FIG. 3, be substantially rectangular in configuration. The second appendage 54 has an outer periphery 60 that may also be substantially rectangular in configuration. The first appendage 52 and the second appendage 54 are spaced a distance 62 apart and substantially parallel to one another. The first appendage 52 has at least one first elongated slot 63. A first fastening element 64 is disposed through the elongated slot 63 and engages the distal end 34 of the second handle 26 so as to substantially and slidably connect the measuring member 50 to the distal end 34 of the second handle 26. The second appendage 54 may also have at least one second elongated slot 65. A second fastening element 66 is disposed through the second elongated slot 65 and engages the distal end 34 of the second handle 26 so as to substantially and slidably connect the measuring member 50 to the distal end 34 of the second handle 26. The first appendage 52 further has a first set of measuring indicia 68 thereon for measuring the first distance 16 from the first side 18 of the sheet of material 12 to the center 37 of the receiver assembly 36. The second appendage 54 further has a third set of measuring indicia 67 thereon for also measuring the first distance 16 from the first side 18 of the sheet of material 12 to the center 37 of the receiver assembly 36. Indeed, the first set of measuring indicia 68 and the third set of measuring indicia 67 are identical and allow a user to see the first distance 16 from the first side 18 of the sheet of material 12 to the center 37 of the receiver assembly 36 from any visual vantage point when looking at the punch assembly 10.

The third appendage 56 of the measuring member 50 is typically disposed at a substantially right angle to the first appendage 52 and extends from the first appendage 52 to the second appendage 54. The third appendage 56 has a second set of measuring indicia 70 thereon for measuring the second distance 20 from the second side 22 of the sheet of material 12 to the center 37 of the receiver assembly 36.

A first side stop 72 is moveably connected to the third appendage 56 for aligning the second side 22 of the sheet of material 12 and positioning the center 37 of the receiver assembly 36 the second distance 20 and therefore to substantially place the center 37 of the receiver assembly 36 at the intersection 14. In an alternate embodiment, second side stop 74 can also be moveably connected to the third appendage 56 for further assisting in aligning the sheet of material 12.

The receiver assembly 36 is disposed below the blade assembly 38 for receiving the blade assembly 38. The blade assembly 38 and the receiver assembly 36 are configured and coordinated such that the receiver assembly 36 matingly receives the blade assembly 38. In one embodiment, the blade assembly 38 is of a substantially cylindrical configuration and the receiver assembly 36 is in a matingly similar configuration.

However, the blade assembly 38 can be interchangeably connected to the distal end 30 of first handle 24 and the receiver assembly 36 can be interchangeably connected to the distal end 34 of the second handle 26 such that the blade assembly 38 and the receiver assembly 36 can be exchanged for different shaped blades and receivers to provide different shaped holes or indentations so long as the blade assembly 38 and the receiver assembly 36 are matingly compatible with one another.

Figure 4:
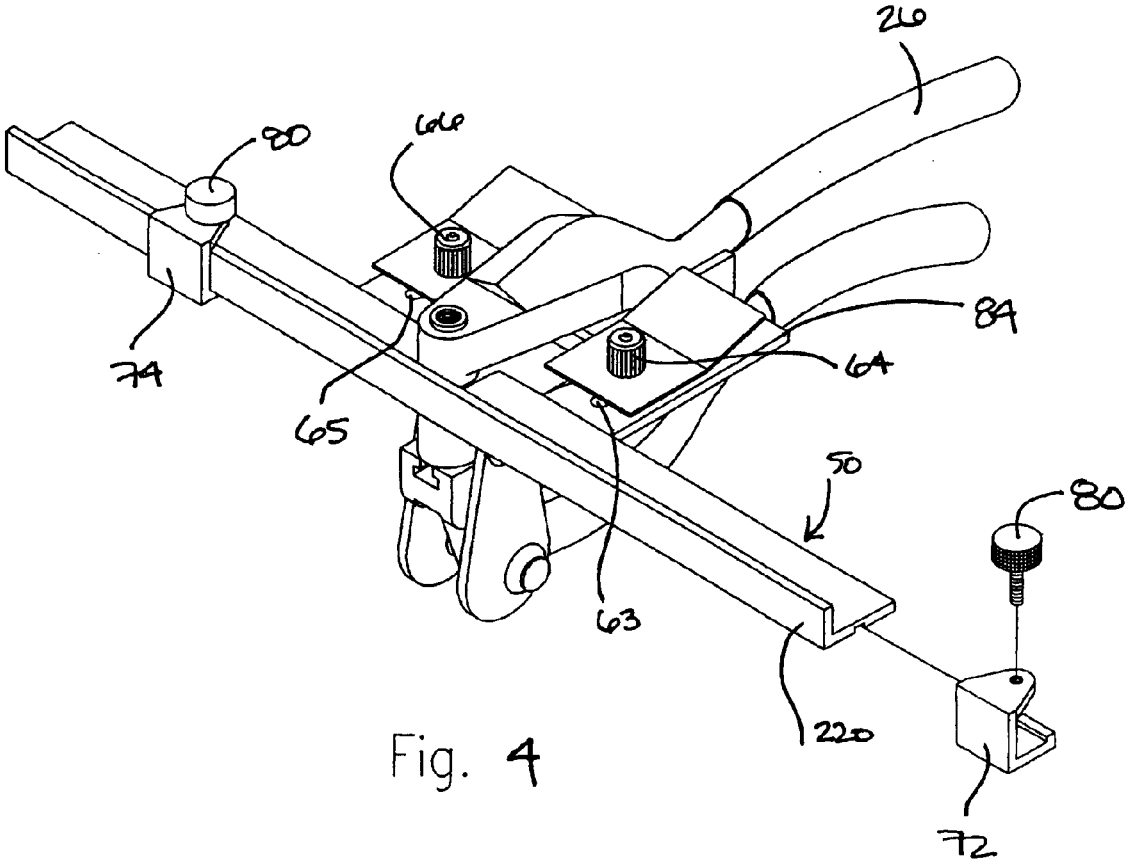
FIG. 4 is a bottom perspective view of the punch assembly of FIG. 1.

Typically, the measuring member 50 is constructed from a relatively thin sheet of metal, although those skilled in the art will readily recognize that the measuring member 50 can be constructed from plastic or any other material suitable for use as the measuring member 50. The third appendage 56 attaches to and is perpendicular to both the first appendage 52 and the second appendage 54 and typically extends a first distance 75 past the first appendage 52 and a second distance 76 past the second appendage 54. The configuration in which the third appendage 56 is attached to the first and second appendages 52, 54, respectively, provides the measuring member 50 with a substantially U-shaped configuration. Referring now to FIG. 4, the first elongated slot 63 and the second elongated slot 65 extend through the first and second appendages 52, 54, respectively, and allow the first fastening element 64 and the second fastening element 66 to be disposed through the first and second appendages 52, 54, respectively, to thereby provide one means for selectively moveably securing the measuring member 50 to the distal end 34 of the second handle 26 of the punch assembly 10. The first fastening element 64 and the second fastening element 66 may be, for example, but not by way of limitation, screws, nuts, bolts, pins, spring loaded pins or derivations and combinations thereof.

The first side stop 72 includes a securing element 80 which is capable of being reversibly tightened to thereby reversibly join the first side stop 72 to the third appendage 56 in a desired location. The first side stop 72 is selectively slidably mounted to the third appendage 56 such that the first side stop 72 remains substantially parallel and coplanar with a rear guide 84 as the first side stop 72 is slidably moved along the third appendage 56. The first side stop 72 also has an inner edge 73 which may be aligned with the second set of measuring indicia 70 on the third appendage 56. The first edge 86 of the first side stop 72 in combination with the second set of measuring indicia 70 visually provide an accurate and reproducible indication of the second distance 20 measured from the first edge 86 of the first side stop 72 to the center of the blade assembly 38 of the distal end 30 of the first handle 24 of the punch assembly 10.

The first, third, and second sets of measuring indicia 67, 68, 70, respectively, can be, by way of example, in inches and fractions of inches or centimeters and millimeters or any other known or fanciful unit of measurement.

In an open condition of the punch assembly 10 (not shown) the blade assembly 38 and the receiver assembly 36 are disposed a distance apart. In a closed condition of the punch assembly 10 (as shown in FIG. 1) the blade assembly 38 is substantially matingly disposed into and/or within the receiver assembly 36. In an alternate embodiment, the punch assembly 10 further includes a spring (not shown) sized, configured, shaped and disposed so as to bias the first handle 24 and the second handle 26 in the open position of the punch assembly 10 such that the blade assembly 38 and receiver assembly 36 are disposed in the open position of the punch assembly 10. The punch assembly 10 may be constructed from metal although it can be constructed of any suitable strong reasonably rigid material such as a hard plastic, ceramic, laminate, composite or combinations of any of these materials. Furthermore, portions of the punch assembly 10 may be constructed of metal and other portions of the punch assembly 10 may be constructed from ceramic, plastic, etc. The punch assembly 10 can further include a force multiplier (not shown) so as to provide additional leverage and impart additional pressure between the blade assembly 38 and the receiver assembly 36 for ease of disposing the blade assembly 38 through the sheet of material 12 disposed between the blade assembly 38 and the receiver assembly 36. Furthermore, the blade assembly 38 and the receiver assembly 36 can be removably connected to the first handle 24 and the second handle 26, respectively, so as to provide an interchangeable feature to the punch assembly 10. For example, although the blade assembly 38 is shown and described as substantially cylindrical in configuration and the receiver assembly 36 is shown as in a hollow cylindrical configuration sized and disposed so as to manually receive the blade assembly 38 into the receiver assembly 36, the blade assembly 38 may also be substantially square in configuration and the receiver assembly 36 sized and configured to receive the blade assembly 38 that is substantially square in configuration so as to punch out square holes instead of round holes in the sheet of material 12.

In use, the first handle 24 and the second handle 26 are disposed so as to place the punch assembly 10 in an open configuration. The securing elements 80 are loosened so as to allow the measuring member 50 and the first and second side stops 72, 74, respectively, of the third appendage 56 to freely move. The first side stop 74 is moved along the third appendage 56 until it aligns with the second set of measuring indicia 70 that represents the desired first distance 16 from the first side 18 of the sheet of material 12. The securing element 80 of the first side stop 72 is tightened to secure the first side stop 72 of the third appendage 56 in the desired position.

The securing elements 80 are loosened such that the measuring member 50 can be moved into a position wherein the first set of measuring indicia and the third set of measuring indicia 64, 67, respectively, on the first and second appendages 52, 54, respectively, represent the second distance 20 from the second side 22 of the sheet of material 12 or, alternatively, the third side 46 of the sheet of material 12.

The sheet of material 12 is thereafter disposed and positioned between the blade assembly 38 and the receiver assembly 36. The securing elements 80 are tightened so as fix the measuring member 50 in the desired position and so as to also prevent the measuring member 50 from inadvertently moving out of the desired position. An inner edge 73 of the first side stop 72 aligns with the second set of measuring indica 70 on the third appendage 56 so as to conveniently display the distance from the inner edge 73 of the first side stop 72 to the center of the blade assembly 38. The securing elements 80 are loosened so as to allow the measuring member 50 to move a desired predetermined distance from the blade assembly 38 and the receiver assembly 36. A back edge 220 of the third appendage 56 is positioned in a desired distance from the rear guide 84.

With the sheet of material 12 properly positioned between the blade assembly 38 and the receiver assembly 36 and properly aligned with the first set of measuring indicia 68 and the second set of measuring indicia 70 as the proximal end 28 of the first handle 24 is moved in a direction toward the proximal end 32 of the second handle 26, the blade assembly 38 punches through the sheet of material 12 and thereby cuts a hole through, or makes an indentation in, the sheet of material 12 at the intersection 14 of the first distance 16 from the first side 18 of the sheet of material 12 and a second distance 20 from the second side 22 of the sheet of material 12.

Figure 5:
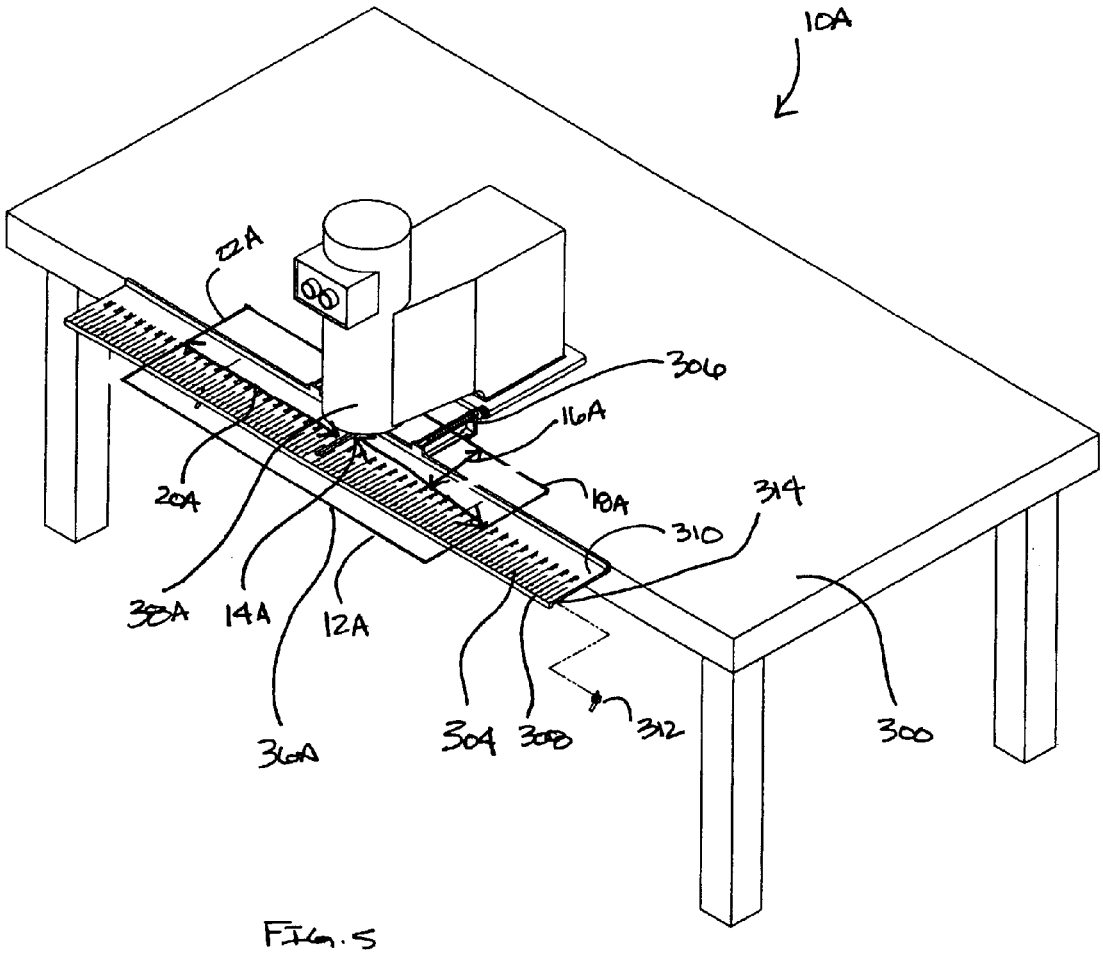
FIG. 5 is a perspective view of another embodiment of the punch assembly of FIG. 1.

Referring now to FIG. 5, shown therein is a punch assembly 10A similar to the punch assembly 10 for punching a hole in a sheet of material 12A at the intersection 14A of a first distance 16A from a first side 18A of the sheet of material 12A and a second distance 20A from a second side 22A of the sheet of material 12A. The punch assembly 10A further includes a blade assembly 38A and a receiver assembly 36A similar to the blade assembly 38 and receiver assembly 36 in the punch assembly 10.

Figure 7:
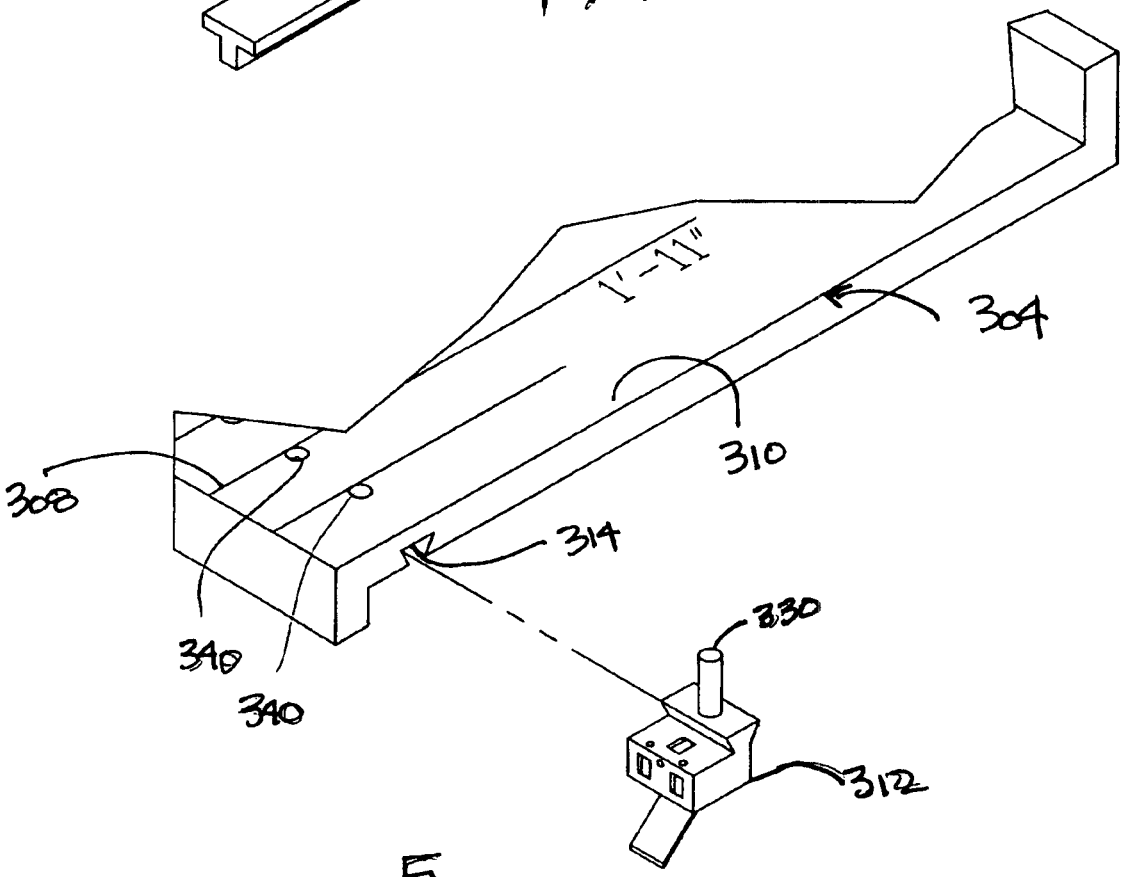
FIG. 7 is a close-up perspective view of a retractable pin and a guide of the punch assembly of FIG. 5.

The punch assembly 10A further includes a platform 300 for support and stability as well as to allow for the application of greater force to the sheet of material 12A that is to be punched. The punch assembly 10A can be a manual punch or an automatic punch (an automatic punch is shown as punch assembly 10A in FIG. 5 although a manual punch, such as punch assembly 10 shown in FIG. 1, may also be used). The punch assembly 10A includes a first guide 304 and a second guide 306. The first guide 304 has a plurality of measuring indicia 308 disposed on an upper surface 310 of the first guide 304. The first guide 304 is typically attached to the platform 300. The first guide 304 also has at least one stop 312. The at least one stop 312 is shown in greater detail in FIG. 7.

The at least one stop 312 is moveably connected within the first guide 304 through a channel 314. The at least one stop 312 is useful in aligning the sheet of material 12A in the punch assembly 10A. The at least one stop 312 may also include a spring loaded pin, a magnet or a threaded nut and bolt or any other fastening type element known in the art for reversibly fixing and ease of adjustment or the first stop.

The at least one stop 312 also includes a retractable pin 330 that extends upwardly from the at least one stop 312. The retractable pin 330 can be moved from a closed configuration, wherein the retractable pin 330 is wholly contained within the at least one stop 312, to a disposed configuration wherein the retractable pin 330 extends outwardly from the at least one stop 312 and engages the first guide 304. When the retractable pin 330 engages the first guide 304, the retractable pin 330 enters and extends through one of a plurality of holes 340 in the first guide 304 wherein the plurality of holes 340 generally are placed in conjunction with the plurality of measuring indicia 308 that are disposed on the upper surface 310 of the first guide 304. In such manner, not only is the at least one stop 312 locked in place but the portion of the retractable pin 330 that extends above the upper surface 310 of the first guide 304 forms a stop upon which the sheet of material 12A may be indexed against for determining the intersection 14A. It is at the intersection 14A that the blade assembly 38A and receiver assembly 36A, in operation, meet such that a hole or indentation are punched into the sheet of material 12A by the punch assembly 10A.

Figure 6:
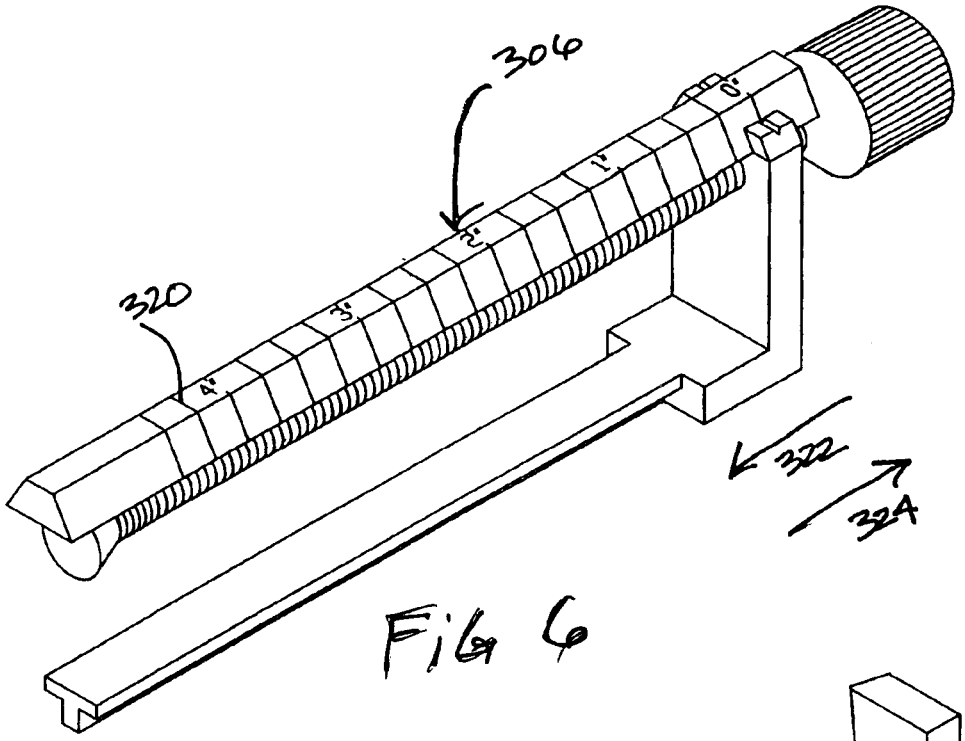
FIG. 6 is a perspective view of a measuring member of the punch assembly of FIG. 5.

The second guide 306 (shown more particularly in FIG. 6) includes a second plurality of measuring indicia 320 for measuring the second distance 20A from the second side 22A of the sheet of material 12A. The second guide 306 can be threaded and attached to the first guide 304 such that as the second guide 306 screws in a first direction 322 the second guide 306 moves the second side 22A of the sheet of material 12A closer to the blade assembly 38A and the receiver assembly 36A, and when the second guide 306 is screwed in an opposite direction 324, the second guide 306 moves the second side 22A of the sheet of material 12A farther from the blade assembly 38A and the receiver assembly 36A.

Thus, it should be apparent that there has been provided in accordance with the present a punch assembly and methods of using same that fully satisfies the objectives and advantages set forth above. Although the invention has been described in conjunction with specific embodiments thereof, it is evident that many alternatives, modifications, and variations will be apparent to those skilled in the art. Accordingly, it is intended to embrace all such alternatives, modifications, and variations that fall within the spirit and broad scope of the appended claims.

What is claimed:

1. A punch assembly for measuring and punching a hole in a sheet of material at the intersection of a first distance and a second distance the punch assembly comprising:

a first handle having a receiver assembly a second handle having a blade assembly, wherein the blade assembly is capable of moving toward the receiver assembly and punching a hole through a sheet of metal and a measuring member slidably connected to the second handle;

the measuring member having a first appendage having a first set of measuring indicia thereon;

a second appendage having a second set of measuring indicia thereon, a third appendage of the measuring member at a substantially right angle; and at least one side top selectively slidably connected to the third appendage of the measuring member for abutting the piece of material against the stop.

2. The punch assembly of claim 1 includes a second slide stop selectively slidably mounted to the third appendage.

* * * * *